US006135064A

United States Patent [19]

Logan et al.

[11] Patent Number: 6,135,064

[45] **Date of Patent: *Oct. 24, 2000**

[54] ENGINE DRAIN SYSTEM

[75] Inventors: Andrew K. Logan; James E. Erickson, both of Stillwater; William E. Hughes, Perry, all of Okla.

[73] Assignee: Brunswick Corporation, Lake Forest, Ill.

[ * ] Notice: This patent issued on a continued prosecution application filed under 37 CFR 1.53(d), and is subject to the twenty year patent term provisions of 35 U.S.C. 154(a)(2).

[21] Appl. No.: 09/400,675

[22] Filed: Sep. 21, 1999

[51] Int. Cl.[7] ..... F01P 11/02

[52] U.S. Cl. ..... 123/41.14; 440/88

[58] Field of Search ..... 440/900, 88; 123/41.14

[56] References Cited

U.S. PATENT DOCUMENTS

| | | | |
|---|---|---|---|
| 4,619,618 | 10/1986 | Patti | 440/900 |
| 4,693,690 | 9/1987 | Henderson | 440/88 |
| 4,699,598 | 10/1987 | Bland | 440/88 |
| 5,067,448 | 11/1991 | Nakase | 123/41.31 |
| 5,329,888 | 7/1994 | Luckett | 123/41.08 |
| 5,362,266 | 11/1994 | Brogdon | 440/88 |
| 5,393,252 | 2/1995 | Brogdon | 440/88 |
| 5,441,431 | 8/1995 | Brogdon | 440/88 |
| 5,579,727 | 12/1996 | Logan et al. | 123/41.14 |
| 5,628,285 | 5/1997 | Logan et al. | 123/41.14 |
| 5,664,526 | 9/1997 | Logan et al. | 123/41.14 |
| 5,980,342 | 11/1999 | Logan et al. | 440/88 |

*Primary Examiner*—Andrew M. Dolinar
*Assistant Examiner*—Hyder Ali
*Attorney, Agent, or Firm*—William D. Lanyi

[57] ABSTRACT

An engine cooling system is provided with a manifold that is located below the lowest point of the cooling system of an engine. The manifold is connected to the cooling system of the engine, a water pump, a circulation pump, the exhaust manifolds of the engine, and a drain conduit through which all of the water can be drained from the engine.

7 Claims, 3 Drawing Sheets

ENGINE DRAIN SYSTEM

BACKGROUND OF THE INVENTION

1. Field of the Invention

The present invention is generally related to an engine drain system and, more particularly, to an engine drain system that allows complete draining of an internal combustion engine from a single point which is connected directly to a manifold that is mounted below the lowest portion of a water cooling system of the internal combustion engine.

2. Description of the Prior Art

Many different types of internal combustion engines are well known to those skilled in the art. In certain applications, such as in marine propulsion systems, internal combustion engines draw cooling water from a body of water in which a watercraft is operated. When the engine is inoperative, a certain quantity of water collects, or pools, within locations of the engine and does not easily drain out of the engine. When the operator of the watercraft wants to drain the cooling water from the engine, the process can be difficult and time consuming. Part of the reason for the difficulty in draining a marine engine is that it is usually necessary to drain the engine from several different locations to assure that all the entrapped water within the engine is removed. If this is not done carefully and completely, the remaining water within the engine block can freeze and cause serious damage to the engine and its related components.

U.S. Pat. No. 5,441,431, which issued to Brogdon on Aug. 15, 1995, describes a fresh water flushing system for a marine engine in a boat. The flushing system can be used whether the boat is in or out of the water. The system comprises a control panel mounted on the interior of the boat, a plurality of tubular T-shaped interconnection fittings in a raw sea water cooling conduit, and a fresh water flush valve. The components are connected for fresh water fluid flow. The fresh water flush valve has a valve plunger for establishing a fresh water flow between the control panel and the T-shaped interconnection fittings.

U.S. Pat. No. 5,393,252, which issued to Brogdon on Feb. 28, 1995, discloses a fresh water flushing system for use in a boat. The system comprises a control panel mounted in the proximity of the marine engine and a fresh water flush valve. Hoses are connected to the fresh water flush valve and also to various components of the marine engine system to provide fresh water fluid flow within the engine. Alternative embodiments are included for marine vessels with more than one engine.

U.S. Pat. No. 5,362,266, which issued to Brogdon on Nov. 8, 1994, describes a flush master fresh water flushing system. The components of the system are connected for fresh water fluid flow with a plurality of standard radiator hoses. The fresh water flush valve has a valve plunger for establishing fresh water flow between the control panel and "T" shaped interconnection fittings. Further, the fresh water flush valve has a plurality of axial outlet ports to proportionally direct the flow of fresh water to the appropriate "T" shaped interconnection fitting in the raw sea water cooling conduit of the marine engine. A valve plug is provided to secure a positive closure when the fresh water flow is disconnected. The valve plug has a tapered body and a "O" ring to affect a positive seal and insure that no fluid backflow occurs when the flushing system is not in use and operation of the marine engine is operating under normal conditions in the sea water. All of the fixed and movable parts are fabricated from material that resists salt air and salt water corrosion.

U.S. Pat. No. 5,067,448, which issued to Nakase et al on Nov. 26, 1991, describes an exhaust cooling device for a small sized boat engine. A small watercraft embodies an improved exhaust system that is substantially completely watercooled by a cooling jacket. The exhaust system includes an elastic joint that is also completely surrounded by the cooling jacket so as to insure adequate cooling under all running conditions. A damming arrangement is incorporated so as to insure that all of the exhaust portions being cooled will be completely encircled with cooling water even when low amounts of water are being circulated and a drain system is also provided to as to insure that the cooling jackets will be drained when the watercraft is removed from a body of water.

U.S. Pat. No. 4,699,598, which issued to Bland et al on Oct. 13, 1987, describes a marine propulsion device with a water supply system. The device comprises an internal combustion engine, a propulsion unit adapted to be pivotally mounted on the transom of a boat for pivotal movement relative to the transom about a generally vertical steering axis, and about a generally horizontal tilt axis, the propulsion unit including a propeller operably connected to the engine. The device also comprises a pump for pumping water from the exterior of the propulsion unit to the engine, and a conduit extending from the pump to the engine and having a low point below both the pump and the connection of the conduit to the engine. It also comprises a drain for draining water from adjacent the low point of the conduit.

U.S. Pat. No. 4,693,690, which issued to Henderson on Sep. 15, 1987, describes a quick drain assembly for a boat engine. The device is used for an inboard boat engine, especially an engine of the type having a water jacket to which a plurality of drain cocks are connected through which engine coolant must be drained after each use of the engine. The quick drain device is in the form of a barrel having a plurality of lateral tubes radiating therefrom. An expandable stopper is received within the barrel and covers the ends of the tube and thereby prevents flow therethrough. The other ends of the lateral tubes are connected to the drain cocks or drain plugs located on the engine block. Removal of the expandable stopper simultaneously drains all of the drain plugs.

U.S. Pat. No. 5,329,888, which issued to Luckett et al on Jul. 19, 1994, discloses a thermostat housing assembly for a marine engine. The housing assembly has a first inlet to receive sea water and an outlet that is connected to the circulating pump that circulates cooling water to the engine. A baffle is located in the housing and prevents direct flow between the sea water inlet and the outlet. The housing defines a pair of passages with a first of the passages providing communication between the sea water inlet and forms a first chamber which communicates with a pair of manifold outlets that are connected to the manifold. A second of the passages provides communication between the sea water inlet and the outlet to the recirculation pump. The housing also includes a return inlet for returning water from the engine and the return inlet is connected to the second passages. A thermostat is mounted in an opening between the passages and when the thermostat is open a portion of the returning cooling water will be directed through the thermostat opening to the first passage and mixed with incoming sea water and then directed to the manifolds.

The patents described above are hereby explicitly incorporated by reference in the description of the preferred embodiment of the present invention.

It would be significantly beneficial if a system could be developed in which a marine propulsion engine can be quickly and easily drained to remove all of the water from the internal chambers of the engine's cooling and exhaust system. It would also be significantly beneficial if a system of this type could be provided in which no water is left remaining within any of the cooling system chambers after completion of the draining operation.

SUMMARY OF THE INVENTION

A preferred embodiment of the present invention provides an engine drain system which comprises an engine having a water cooling system and a manifold having internal passages, wherein the manifold is connected in fluid communication with the water cooling system of the engine. The manifold is disposed below the level of the lowest portion of the water cooling system which normally retains cooling water when the engine is not operating. A drain is also provided and connected in fluid communication with the manifold to allow all of the water within the engine cooling system to drain through the manifold and away from the engine. A water pump can be connected to a first inlet of the manifold and a circulation pump can be connected to a first outlet of the manifold. The circulation pump is connected in fluid communication with the water cooling system of the engine. A second inlet of the manifold is connected to the water cooling system of the engine to receive water from the water cooling system after the water has passed through the water cooling system of the engine.

A preferred embodiment of the present invention further comprises an exhaust system to conduct exhaust gases out of and away from the engine. A second outlet is connected in fluid communication between the manifold and the exhaust system. The second outlet can comprise two conduits which are each connected in fluid communication with individual portions of the engine's exhaust system. A valve is connected in fluid communication with a drain conduit to selectively open and close the drain conduit when an operator desires to drain the engine. The engine can be a portion of a marine propulsion system which, in turn, can comprise a stern drive unit. A thermostat mounted on the intake manifold can be used to control the relative flows of water through the first and second outlets as a function of a temperature of the engine.

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 1:
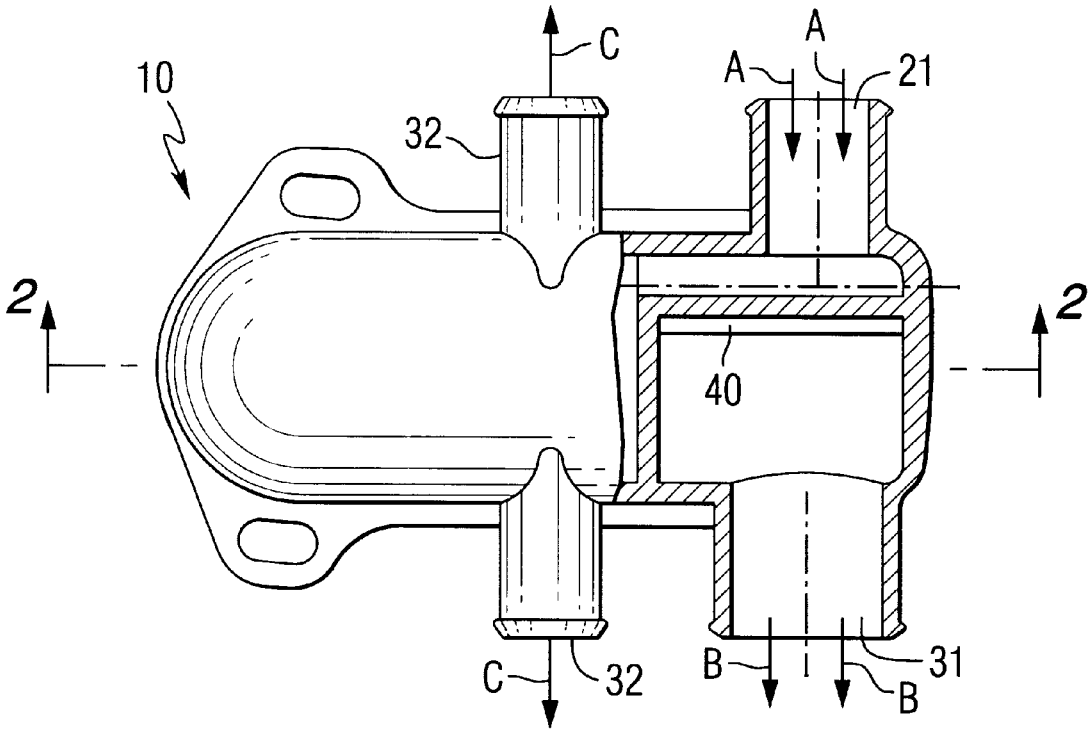
FIG. 1 PRIOR ART
FIGS. 1 and 2 show a known type of thermostat housing.

Throughout the description of the preferred embodiment of the present invention, like components will be identified by like reference numerals.

Figure 2:
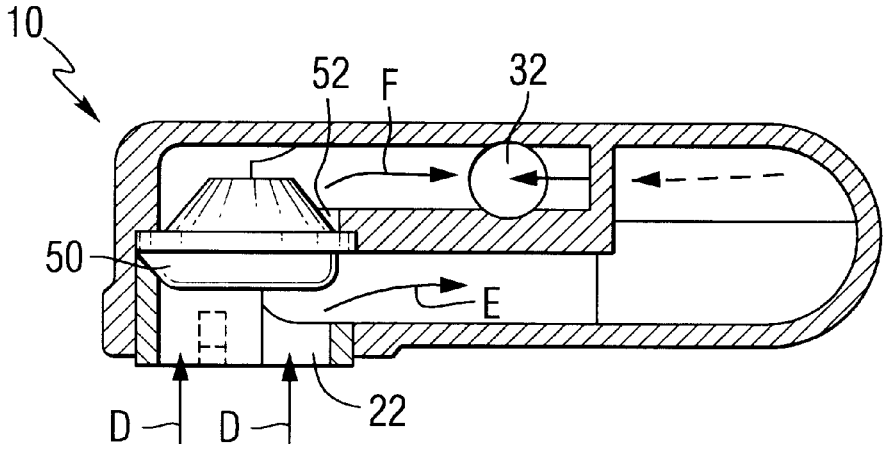
FIG. 2 PRIOR ART

FIGS. 1 and 2 show a prior art thermostat housing that is described in significant detail and illustrated in U.S. Pat. No. 5,329,888. FIG. 2 is a section view taken of FIG. 1 as indicated. With reference to both FIGS. 1 and 2, water is drawn from a body of water, such as a lake, and pumped into the housing 10 through a first inlet 21. The water flows into the housing 10 as indicated by arrows A. As described in detail in U.S. Pat. No. 5,329,888, a baffle structure 40 divides the incoming water flow along two paths. Some of the water flows through a first outlet 31 and the remaining portion of the water flows through a second outlet 32 which can comprise two conduits, as shown in FIG. 1, which are each connected to a separate portion of the engine exhaust system. The water flowing through the second outlet 32 is used to maintain the temperature of the exhaust manifolds below a preselected temperature range. Otherwise, the exhaust manifolds can possibly be damaged by the excessive temperatures that are typical in the exhaust stream of an internal combustion engine.

Water passing through the first outlet 31 is received by a circulation pump (not shown in FIGS. 1 and 2) and directed through a cooling system of an internal combustion engine. The cooling system typically comprises numerous chambers and passages that cool the engine block and cylinder heads of the engine. After passing through the engine, the cooling water is directed into a second inlet 22 of the housing 10 as represented by arrows D. If the engine cooling water is below a predetermined temperature, a thermostat 50 remains closed and the water flowing into the second inlet 22 from the engine passes in the direction represented by arrow E in FIG. 2. This occurs when the thermostat 50 blocks the alternative passage 52 that would otherwise allow the water to flow from inlet 22 toward the second outlet 32.

When the cooling water reaches a sufficient temperature to cause the thermostat 50 to open passage 52, some of the water flowing into the second inlet 22, as indicated by arrows D, is able to pass through opening 52, as indicated by dashed line arrow F, toward the second outlet 32.

When the thermostat 50 is closed, and the return water from the engine flows in the directions represented by arrows D and E, with some of the water again flowing out of the first outlet 31 while another portion of it flows out of the second outlet 32. As described in detail in U.S. Pat. No. 5,329,888, the thermostat shown in FIGS. 1 and 2 allows cooling water to be recirculated from the first outlet 31, through the engine, and back into the second inlet 22 continually until the thermostat 50 reaches a sufficient temperature to open passage 52. As the water is being recirculated through the engine, other cooling water is caused to flow through the second outlet 32 to assure that some cooling water is flowing to the exhaust manifolds at all times. The recirculation of the water, as represented by arrows B, D, and E, allows the engine to rise in temperature during the initial operation of the marine propulsion engine. After the engine cooling system has reached a satisfactory operating temperature, the thermostat 50 allows more cold water to pass from the first inlet 21 to the first outlet 31 to maintain the temperature of the engine cooling system below a preselected value.

Figure 3:
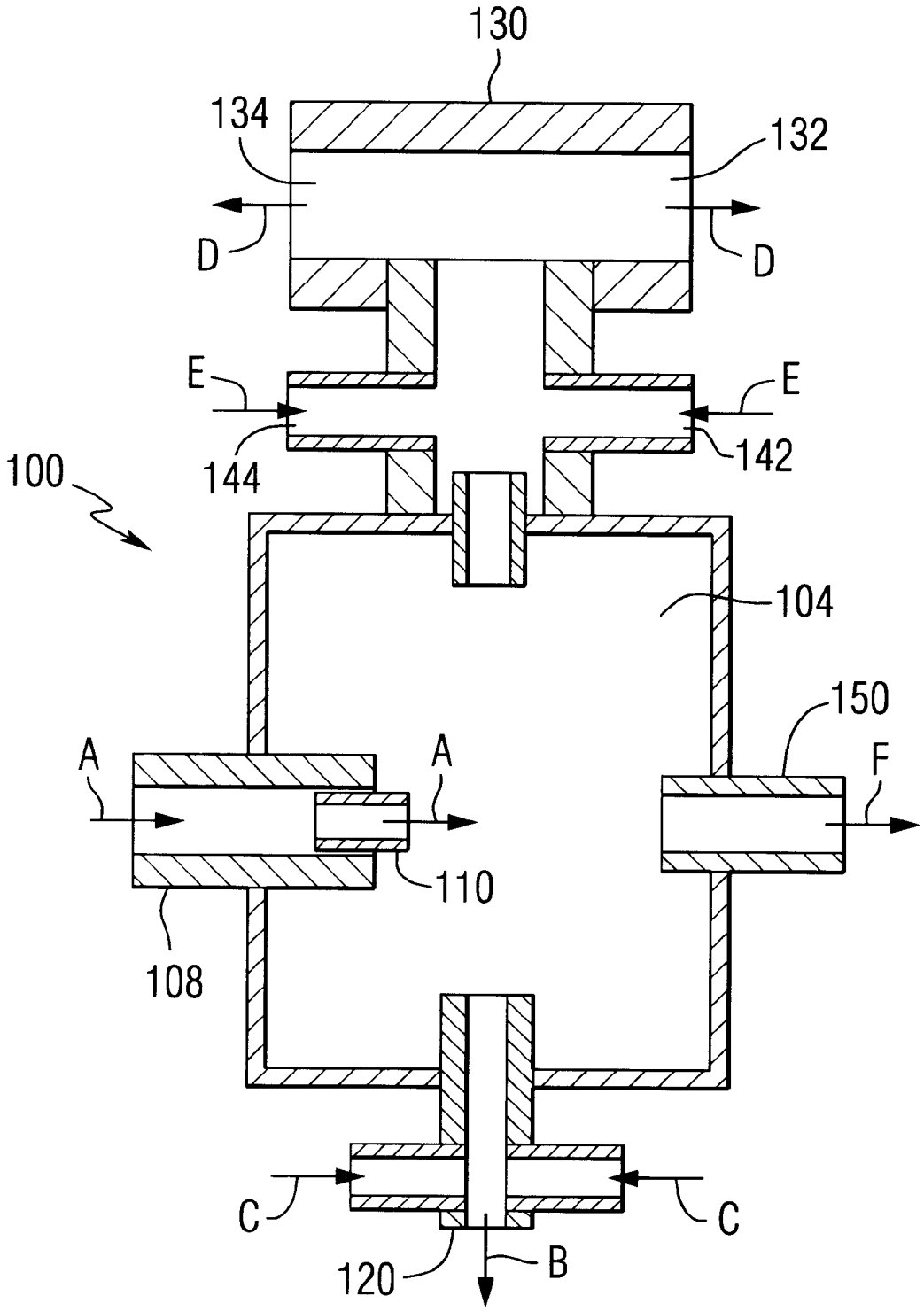
FIG. 3 is a simplified sectional view of a manifold according to the present invention.

FIG. 3 illustrates a manifold housing used in a preferred embodiment of the present invention. A main chamber 104 is connected in fluid communication with a conduit 108 that is connectable to a water pump. As can be seen, conduit 108 is provided with an orifice 110 that controls the rate of water flowing into the main chamber 104, as identified by arrows A. Water can flow out of the main chamber 104, as represented by arrow B, through conduit 120. This water is then directed to a circulating pump which will be described below in conjunction with FIG. 4. Arrows C indicate the direction in which water flows from the engine block to the manifold 100. As can be seen in FIG. 3, conduit 120 has a plurality of openings. The connections to these openings will be described in greater detail below in conjunction with FIG. 4.

Conduit 130 in FIG. 3 provides two openings, 132 and 134, through which water can flow from the manifold 100 to the drain housings of the engine. The direction of this flow is represented by arrows D. Conduit 130 also has two openings, 142 and 144, into which water can flow from the exhaust manifolds of the engine, in the direction represented by arrows E.

Figure 4:
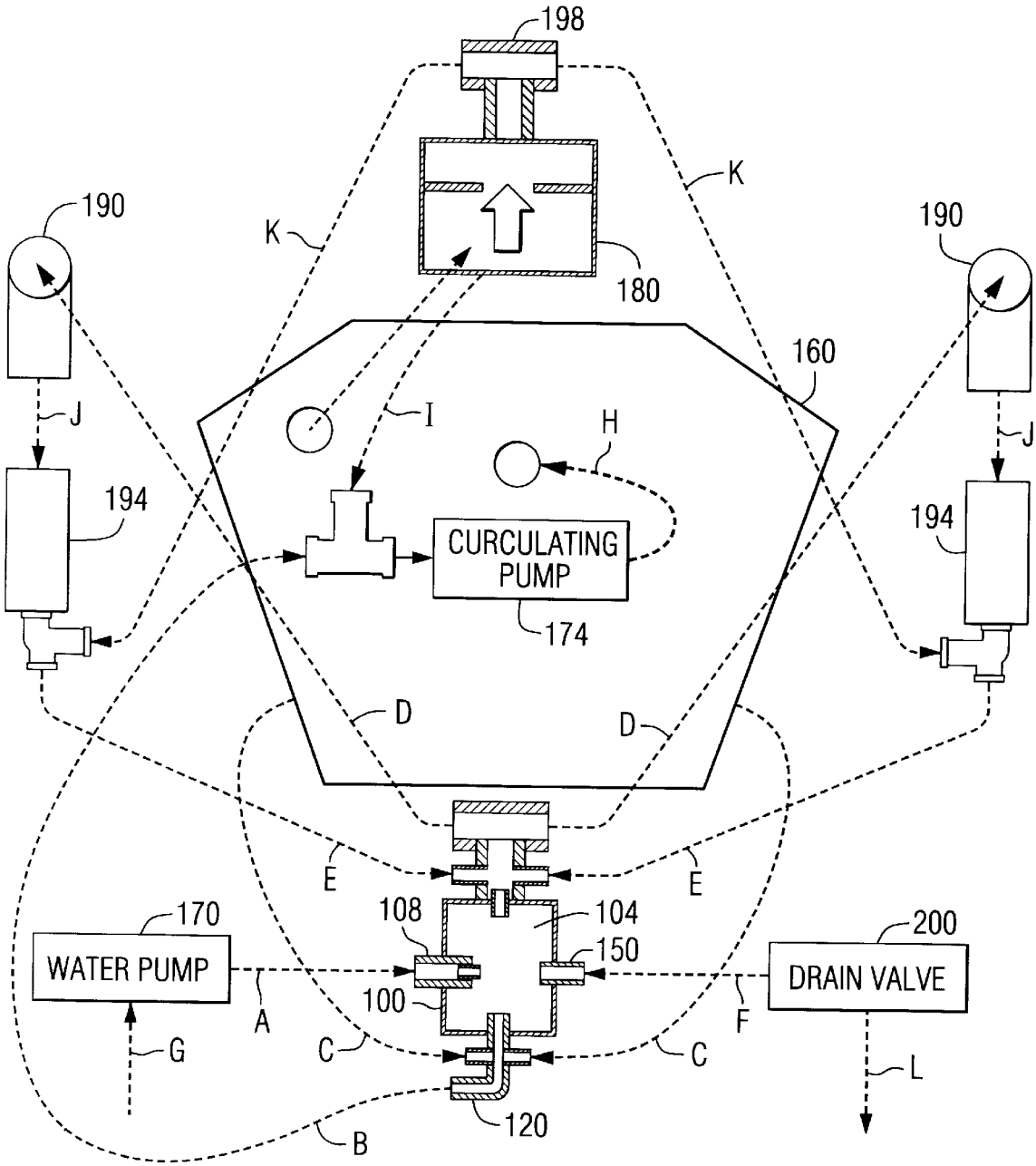
FIG. 4 is an schematic representation of the interconnections between an engine cooling system, a circulation pump, a water pump, a drain valve, an exhaust system of the engine, and a manifold made in accordance with the present invention and located appropriately according to the present invention.

Also shown in FIG. 3 is a drain conduit 150 through which water can flow, in the direction represented by arrow F, when a drain valve is opened. The location of the manifold 100, as will be described in greater detail in conjunction with FIG. 4, is below the cooling passages of the engine. As a result, when a valve is opened to allow water to flow through the drain conduit 150, in the direction represented by arrow F, all of the water within the engine can drain through the manifold 100 from the engine and its associated components, such as the exhaust system. As a result, significant damage can be avoided that would otherwise be possible if water was left remaining in portions of the cooling system. If water is entrapped in portions of the cooling systems, it can freeze and cause significant damage to the engine and its associated components.

FIG. 4 shows a schematic representation of the directions of water flow through the engine 160 and its associated components. Water is pumped from a body of water, such as the lake or ocean, in the direction represented by arrow G, by a water pump 170. The water pump causes pressurized water to flow in the direction represented by arrow A, through conduit 108, and into the main chamber 104 of the manifold 100. Some of the water flows from the main chamber 104, through conduit 120, as represented by arrow B, to a circulating pump 174. From the circulating pump 174, water is caused to flow into the engine as represented by arrow H. The circulating pump 174 also causes water from the thermostat housing 180, as indicted by arrow I, to be pumped into the engine 160 as represented by arrow H.

The water that flows from the manifold 100 to the exhaust elbows 190, as represented by arrows D, cools the exhaust elbows and then flows, as represented by arrows J, to the exhaust manifolds 194. The water from the exhaust manifolds then flows, as represented by arrows E, back to the manifold 100. Water flowing through the thermostat, 180 and conduit 198, as represented by arrows K, flows to the exhaust manifolds 194 and continues toward the manifold 100, as represented by arrows E.

With continued reference to FIG. 4, water can flow from holes in the engine block 160, as represented by arrows C, and join the water flowing from the main chamber 104 to the circulating pump 174.

Because of the location of the manifold 100 below the cavities of the engine in which water can be entrapped, a drain valve 200 can be connected to the drain conduit 150 to allow water to flow out of the main chamber 104 when the drain valve 200 is opened. This flow, represented by arrow L, allows water to flow from the manifold 100 back to the body of water from which it was originally obtained. Alternatively, the drain valve 200 can be configured in such a way that the water draining from the main chamber 104, as represented by arrow L, flows into the bilge of the boat in which the engine 160 is located or overboard. The position of the manifold 100 below the passages of the engine cooling system allows all of the water to drain from the engine, the exhaust elbows 190, the exhaust manifolds 194, the circulating pump 174, the thermostat device 180, and all of the internal passages of the cooling system of the engine 160 to the main chamber 104, through the drain conduit 150 and the drain valve 200 to be removed as represented by arrow L.

The present invention provides a simple and efficient way in which all of the cooling water can be drained from an engine to avoid freezing damage.

Although the present invention has been described in particular detail and illustrated to show the complete water flow and draining configuration of a system employing the invention, it should be understood that alternative arrangements are also within the scope of the present invention.

What is claimed is:

1. An engine drain system, comprising:

an engine having a water cooling system, said water cooling system comprising internal passages within an engine block of said engine;

a manifold having internal passages and connected in fluid communication with said water cooling system, said manifold being disposed below the level of the lowest portion of said internal passages within said engine block of said engine which normally retains cooling water when said engine is not operating; and a drain conduit connected in fluid communication with said manifold, whereby said internal passages within said engine block of said engine can be effectively drained through said drain conduit under the effect of gravity.

2. The system of claim 1, further comprising:

a water pump connected in fluid communication with said manifold for pumping water from a body of water and into said manifold.

3. The system of claim 2, further comprising:

a water cooled exhaust system of said engine connected in fluid communication with said manifold.

4. The system of claim 3, further comprising:

a circulation pump connected in fluid communication between said manifold and said water cooling system of said engine.

5. An engine drain system, comprising:

an engine having a water cooling system, said water cooling system comprising internal passages within an engine block of said engine;

a manifold having internal passages and connected in fluid communication with said water cooling system, said manifold being disposed below the level of the lowest portion of said internal passages within said engine block of said engine which normally retains cooling water when said engine is not operating;

a drain conduit connected in fluid communication with said manifold; and a water cooled exhaust system of said engine connected in fluid communication with said manifold, whereby said internal passages within said engine block of said engine and said water cooled exhaust system can be effectively drained through said drain conduit under the effect of gravity.

6. The system of claim 5, further comprising:

a water pump connected in fluid communication with said manifold for pumping water from a body of water and into said manifold; and a circulation pump connected in fluid communication between said manifold and said water cooling system of said engine.

7. An engine drain system, comprising:

an engine having a water cooling system, said water cooling system comprising internal passages within an engine block of said engine;

a manifold having internal passages and connected in fluid communication with said water cooling system, said manifold being disposed below the level of the lowest portion of said internal passages within said engine block of said engine which normally retains cooling water when said engine is not operating;

a drain conduit connected in fluid communication with said manifold;

a water cooled exhaust system of said engine connected in fluid communication with said manifold;

a water pump connected in fluid communication with said manifold for pumping water from a body of water and into said manifold; and a circulation pump connected in fluid communication between said manifold and said water cooling system of said engine, whereby said internal passages within said engine block of said engine can be effectively drained through said drain conduit under the effect of gravity and without the need for either said water pump or said circulation pump being activated.

* * * * *